United States Patent [19]

Babcock

[11] Patent Number: 4,898,404

[45] Date of Patent: Feb. 6, 1990

[54] CHILDREN'S BOOK PROVIDING A CONTINUOUS ROADWAY

[76] Inventor: Richard L. Babcock, 516 Birchwood Dr., Sandusky, Ohio 44870

[21] Appl. No.: 308,649

[22] Filed: Feb. 9, 1989

[51] Int. Cl.[4] ..... B42D 1/00; E01B 23/00; A63H 18/02

[52] U.S. Cl. ..... 281/15.1; 283/63.1; 281/51; 281/3.1; 446/444; 446/71; 238/10 B

[58] Field of Search ..... 446/444, 147, 71; 281/15 R, 29, 15.1, 51, 3.1; 283/63.1, 64, 34, 35; 238/10 C, 10 B, 10 R

[56] References Cited

U.S. PATENT DOCUMENTS

| | | | |
|---|---|---|---|
| 1,569,390 | 1/1926 | Parker | 283/35 X |
| 2,309,244 | 1/1943 | Fey | 283/63.1 X |
| 3,206,887 | 9/1965 | Eyler et al. | 446/93 |
| 4,487,590 | 12/1984 | Becker et al. | 281/15 R X |
| 4,616,851 | 10/1986 | Mann | 281/15 R |

FOREIGN PATENT DOCUMENTS

| | | | |
|---|---|---|---|
| 454195 | 1/1950 | Italy | 283/34 |

*Primary Examiner*—Mickey Yu

*Attorney, Agent, or Firm*—Pearne, Gordon, McCoy & Granger

[57] ABSTRACT

A children's book providing a plurality of separate roadway landscapes which are exposed as the pages are turned. The book provides extensions along one side which can be used as handles to carry the book and which also provide roadway sections on which a toy vehicle can be positioned while the pages are being turned. The roadways on the various landscapes are aligned with the roadway sections on the projections so that a toy vehicle can be driven onto the roadway sections provided by the projections prior to the turning of the pages and subsequently driven off the roadway sections provided by the projections after the pages are turned.

13 Claims, 8 Drawing Sheets

CHILDREN'S BOOK PROVIDING A CONTINUOUS ROADWAY

BACKGROUND OF THE INVENTION

This invention relates generally to children's books, and more particularly to a novel and improved children's book having a plurality of pages with roadway landscapes printed thereon along which toy vehicles can be moved by children, and which provides an extension on which such vehicles can be positioned when pages are turned.

PRIOR ART

Children's books and pads having landscapes and roadways printed thereon are known. For example, U.S. Pat. No. 4,487,590 discloses a book in which a number of different landscapes are provided in the book. In such books, a child can change the landscape by turning the pages.

U.S. Pat. No. 3,206,887 discloses a pad having separable pages with landscapes printed thereon. Each landscape includes a roadway along which a toy vehicle can be moved. The roadways on the individual pages are arranged so that they can be assembled with other pages to provide a road system including a number of pages.

SUMMARY OF THE INVENTION

The present invention provides a novel and improved children's book in which a number of different roadway landscapes are provided. The child can change the landscapes merely by turning the pages. The cover of the book provides extension portions projecting beyond the edges of the pages. Such extensions have sections of road printed thereon.

In use, the child moves a toy vehicle along the roadway printed on a particular landscape. When the child wishes to turn the page to expose a new landscape, the toy vehicle is moved along the landscape roadway onto the roadway sections on the extension. In such position, the toy vehicle is located off the pages and the pages can be turned to expose another landscape with a different roadway system. The toy vehicle is then moved from the roadway section on the extension back onto the newly exposed roadway system.

Each of the roadways on each of the landscapes is positioned on the pages so that it joins with the roadway section on the extension. Therefore, the child can move the toy vehicle along connected roadways as the pages are turned.

Preferably, the extensions are formed on the covers of the book along the edges thereof remote from the hingelike connection connecting the covers and the pages. Further, the extensions are preferably formed with openings to receive the child's fingers so that the extensions also serve as handles for the book.

With this invention, a large number of separate but interrelated roadway landscapes are provided in a single compact book which the child can play with on a table, the floor, or even while holding the book in his or her lap. Further, more than one child can play with the book at the same time.

These and other aspects of this invention are illustrated in the accompanying drawings and more fully described in the following specification.

DETAILED DESCRIPTION OF THE DRAWINGS

Figure 1:
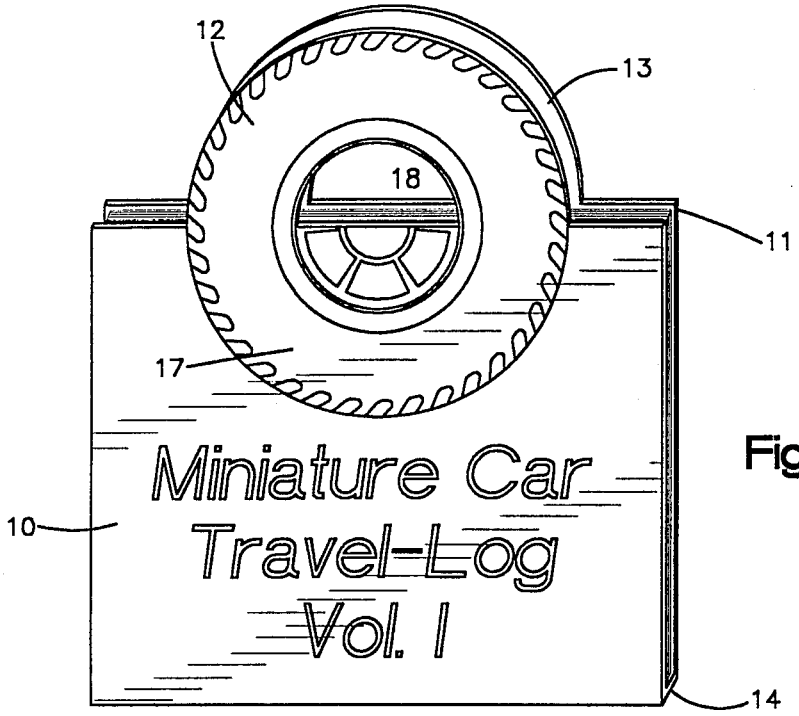
FIG. 1 illustrates a children's book in accordance with the present invention when closed.

A book in accordance with the present invention provides front and back covers 10 and 11 which are generally rectangular in cross section and which respectively provide semicircular extensions 12 and 13. The two covers are connected along their edges remote from the extensions 12 and 13 by a hinge 14 so that the covers can be moved from a closed position, illustrated in FIG. 1, to an open, flat position, illustrated in the remaining figures. The hinge structure is selected so that the book opens substantially flat so that the covers are coplanar.

The book also includes a number of pages, also connected to the hinge 14. Preferably, the covers 10 and 11 are formed of relatively stiff, cardboardlike material and the pages are formed of relatively thin, paperlike material. The covers and pages are formed of a material which resists staining and provides sufficient strength to survive the use of the book by small children, or is coated to provide such properties.

The outside of each of the covers is preferably printed with an auto wheel and tire 17 which extends around the associated semicircular extensions 12 and 13 and also along the rectangular portion of the cover.

The semicircular extensions 12 and 13 are formed with semicircular openings 18 through which children can insert their fingers when they are carrying the book from one location to another. The extensions function as handles when the book is closed. Usually, the front cover is also printed with a suitable title, such as the title illustrated in FIG. 1.

The insides of the covers 10 and 11, and the pages 16 are printed with a variety of landscapes on facing pages. When the book is open, the various landscapes extend the full width of the open book. Substantially any number of different landscapes can be provided in a given book by merely selecting an appropriate number of pages.

Each of the landscapes provides a roadway 21 as part of the landscape. Also, the inner sides of the two extensions 12 and 13 are provided with semicircular roadway sections 22 and 23, respectively. In the illustrated embodiment, all of the roadways are two-land roads provided with center striping 24.

Figure 3:
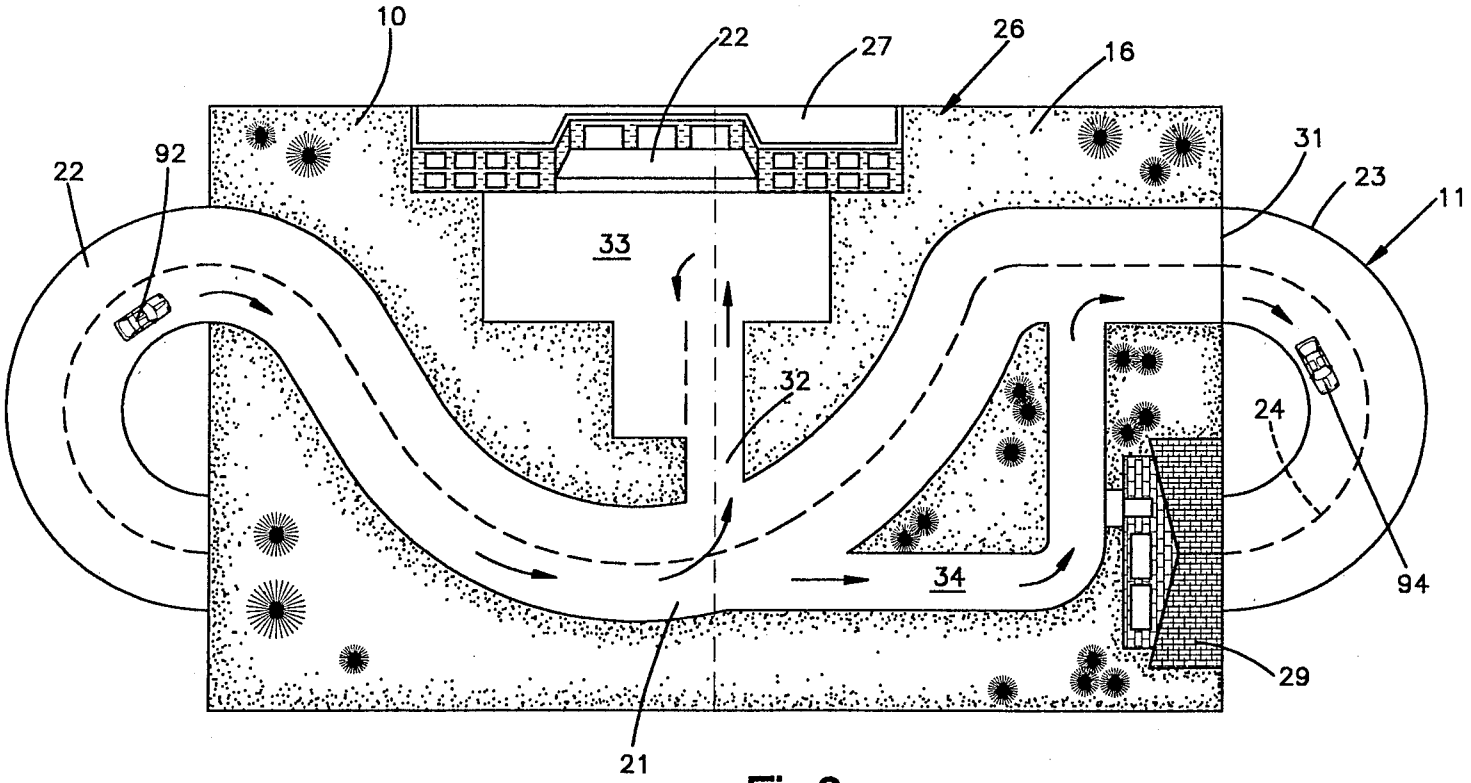
FIG. 3 is an enlarged plan view of the book illustrating a first landscape, including a factory and a post office.

FIG. 3 illustrates the first landscape provided on the inside of the cover 10 in conjunction with the first page 16 of the book. This landscape 26 illustrates a factory 27 having a loading dock 28. Also illustrated in the landscape 26 is a post office 29. The roadway 21 extends along the first page 16 from an end 31 aligned with one end of the roadway section 23 of the back cover 11 past the factory 27 to the roadway section 22 of the front cover 10. A driveway 32 connects the roadway 21 and a parking area 33 for the factory 27. Similarly, a driveway 34 joining the roadway 21 passes in front of the post office 29.

Figure 4:
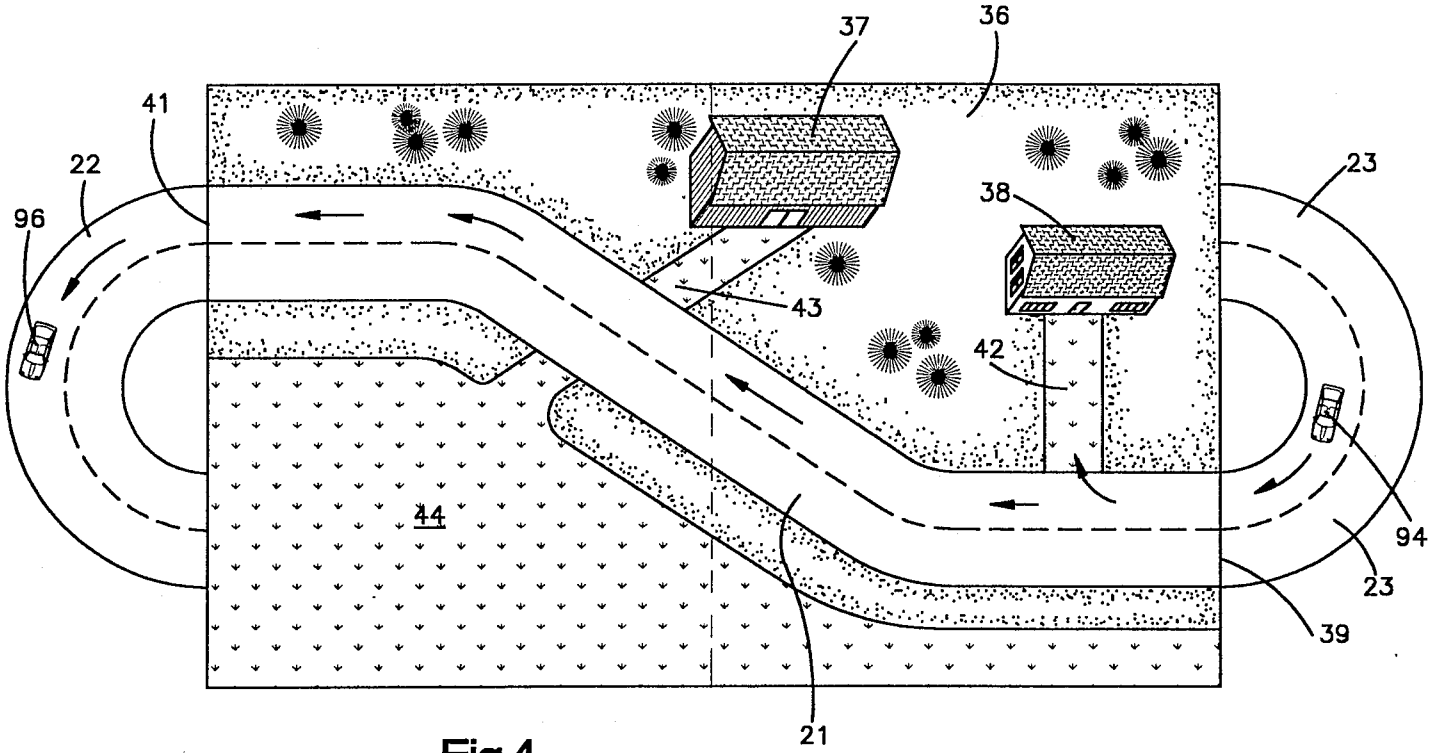
FIG. 4 illustrates another rural landscape which includes a farmhouse and barn.
Figure 5:
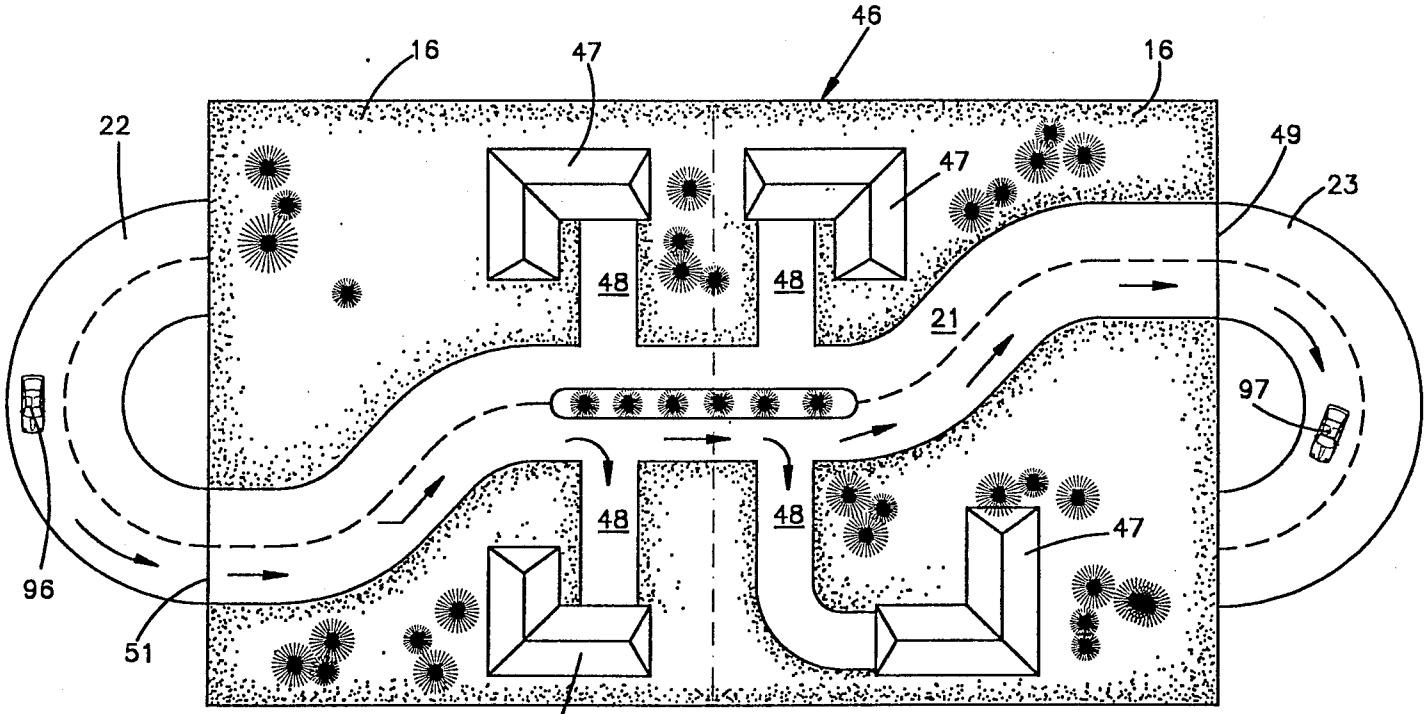
FIG. 5 illustrates another landscape representing a residential area.

When the first page is turned, a second landscape, illustrated in FIG. 4, is exposed between the two facing pages of the book. This landscape 36 illustrates a farm scene with a farmhouse 37 and a barn 38. The roadway 21 extends from an end 39, joining the other end of the roadway section 23 across the landscape to an end 41, where it joins one end of the roadway section 22. In this landscape, the farmhouse is connected to the roadway by a drive 42 and an underpass 43 is provided to connect a cultivated field 44 with the barn 38.

by turning the next page, still another landscape 46 appears, as illustrated in FIG. 5. This particular landscape illustrates a residential district having four homes 47 each connected to the roadway 21 by a driveway 48. Here again, the roadway 21 of this landscape 46 extends across the landscape from an end 49, joining one end of the roadway section 23 to an opposite end 51 joining the roadway section 22.

Figure 2:
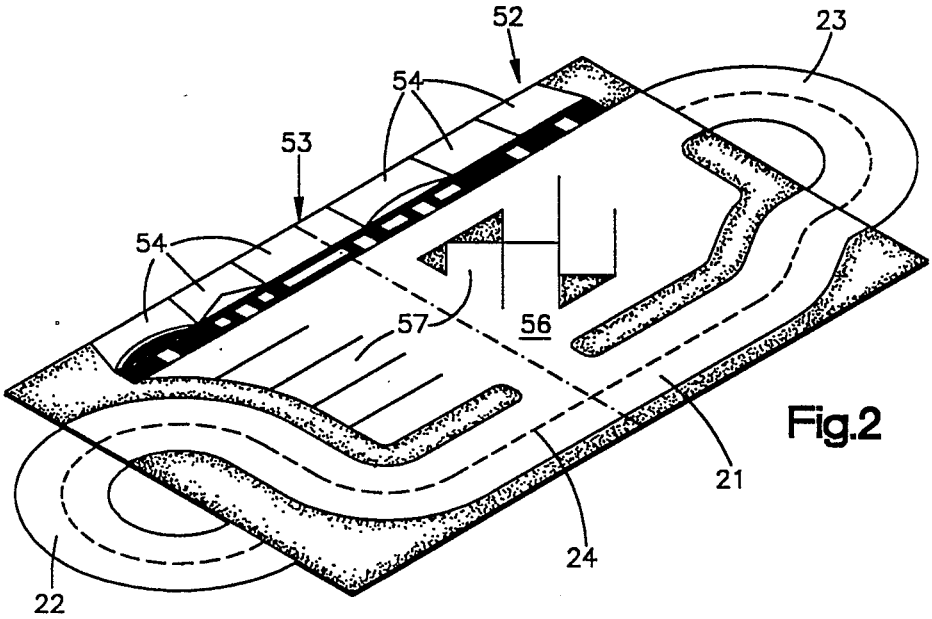
FIG. 2 is a perspective view of the book when it is opened to a flat position illustrating one of the roadway landscapes representing a shopping center.
Figure 6:
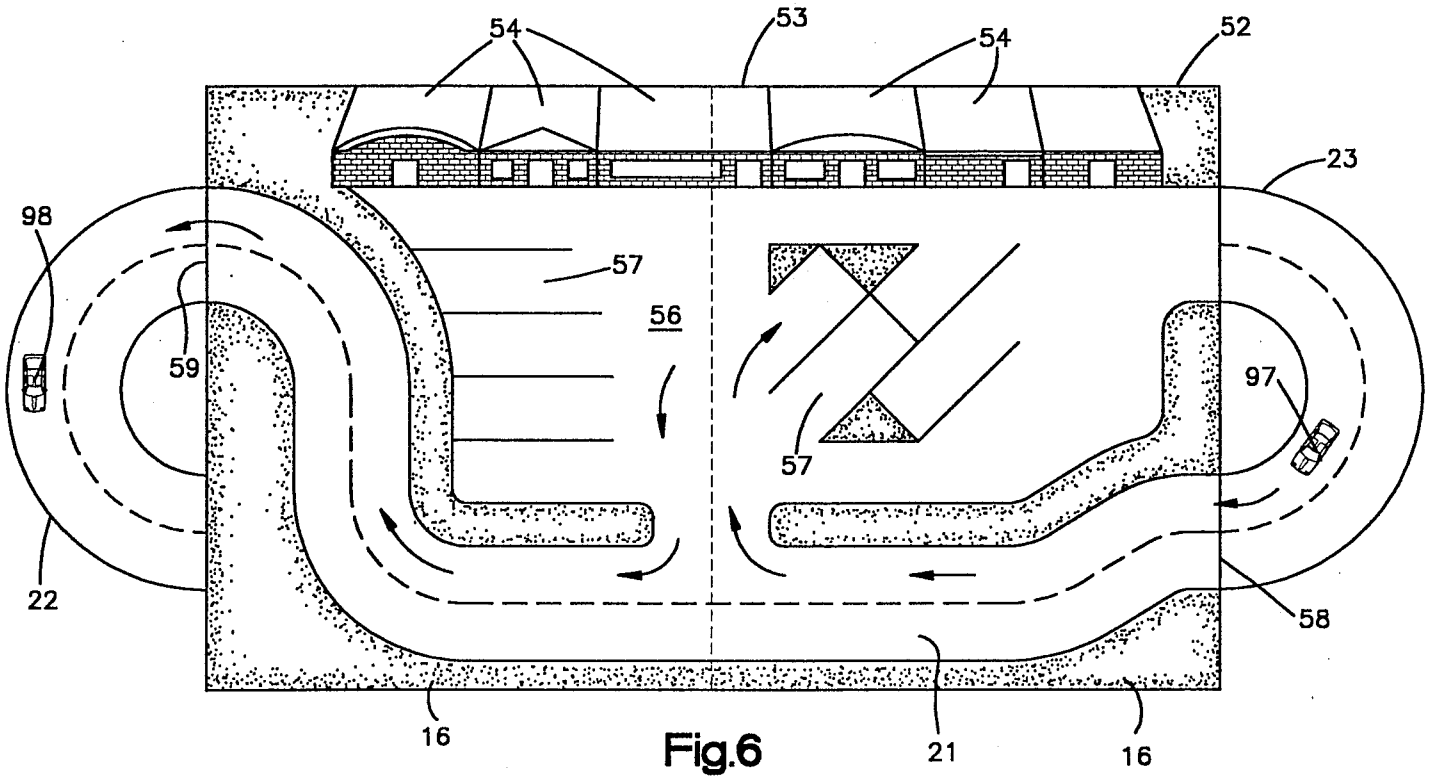
FIG. 6 illustrates still another landscape including a shopping center, also illustrated in FIG. 2.

When a page is turned again, a landscape 52 appears on the two facing pages 16 of the book, illustrated in FIGS. 2 and 6. In this landscape 52, a shopping center 53 is illustrated having six stores 54. In front of the shopping center 53 is a parking lot 56 having two types of parking spaces 57. Again, the roadway 21 extends across the full width of the landscape 52 and is joined at one end 58 to the roadway section 23 and at the other end 59 to the roadway section 22.

Figure 7:
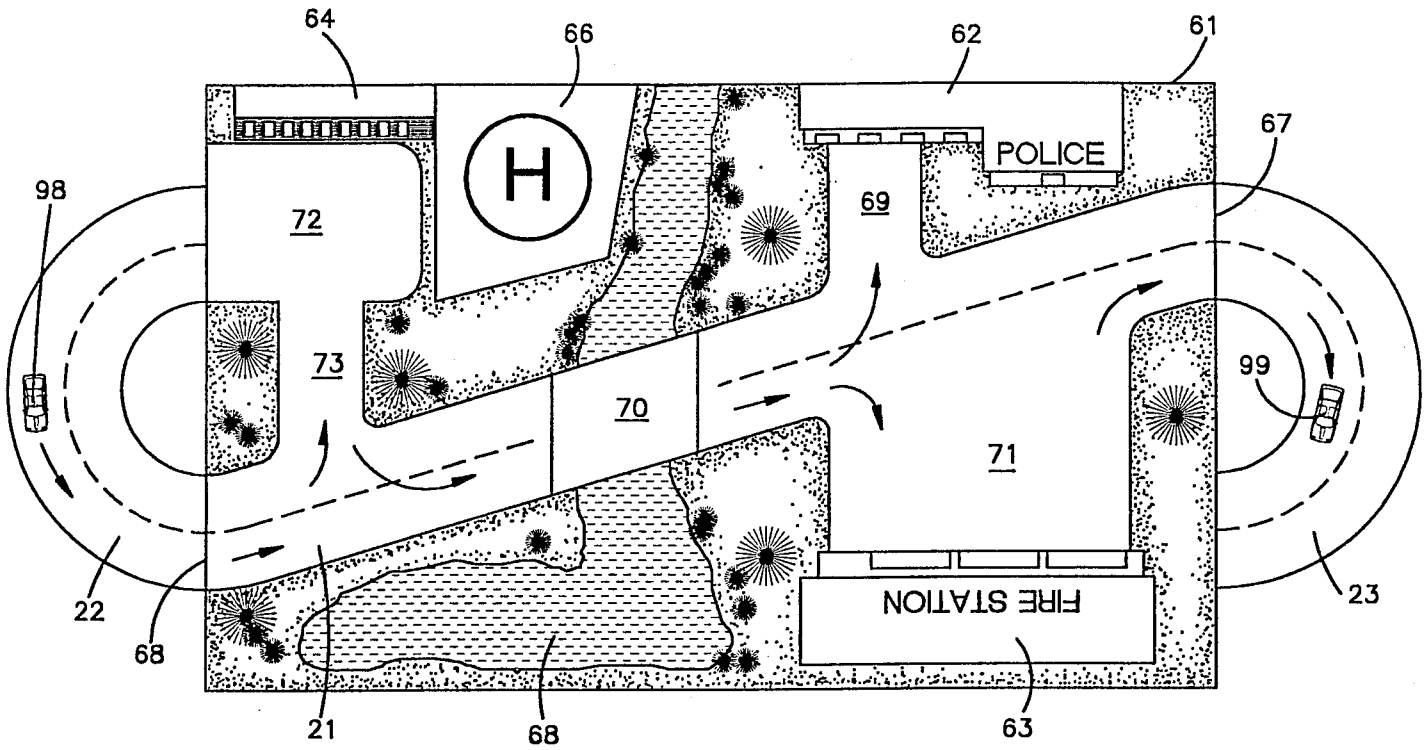
FIG. 7 is a landscape illustrating safety services, including police and fire stations and a hospital.

On the next facing pages, illustrated in FIG. 7, still another landscape 61 is provided. In this landscape, the various safety services are illustrated, which include a police station 62, a fire station 63, and a hospital 64. Adjacent the hospital 64 is a heliport 66, where helicopters can land. Here again, the roadway 21 extends across the landscape 61 from one end 67, where it joins the roadway extension 23 to its opposite end 68, which joins the roadway extension 22. In this instance, the roadway is provided with a bridge 70, passing over a stream 68. The police station 62 is joined to the roadway 21 by a driveway 69. Similarly, the first station 63 is connected to the roadway by a wide entrance drive 71. The hospital parking lot 72 is connected to the roadway by a drive 73.

Figure 8:
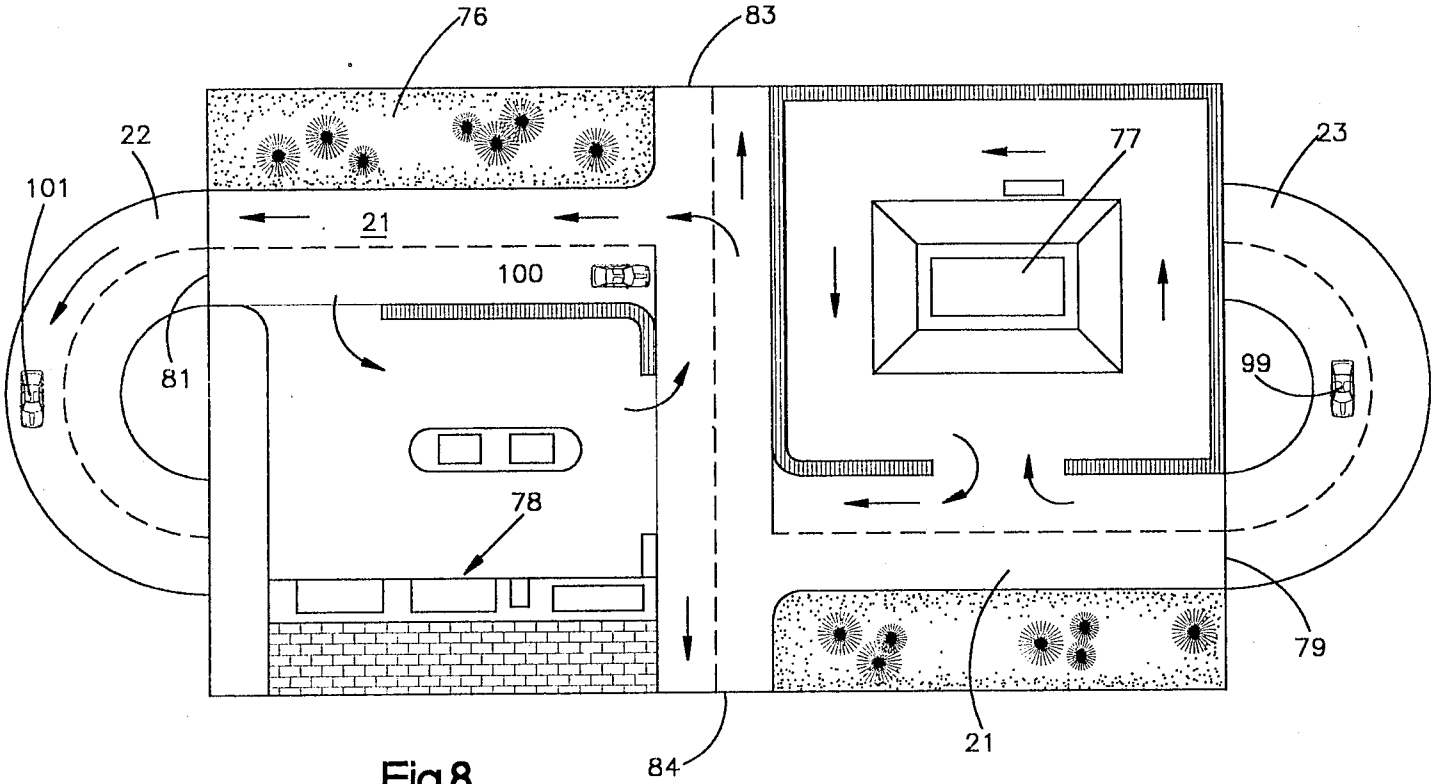
FIG. 8 is a landscape illustrating a fast-food restaurant and a service station.

When the next page 16 is turned, the facing pages provide still another landscape 76, illustrated in FIG. 8. In this instance, the landscape 76 illustrates a fast-food drive-through restaurant 77 and a garage and filling station 78. Here again, the roadway 21 extends across the landscape from one end at 79 adjoining the roadway; section 23 to an opposite end 81 where it joins with the roadway section 22. In this instance, the roadway also extends to ends 83 and 84 at the top and bottom edges of the book. When the child has a similar roadway book with still further landscapes, the two books can be placed adjacent to each other so that the ends 83 or 84 join with the roadway of the second book to allow the child to drive a vehicle from one book to another.

Figure 9:
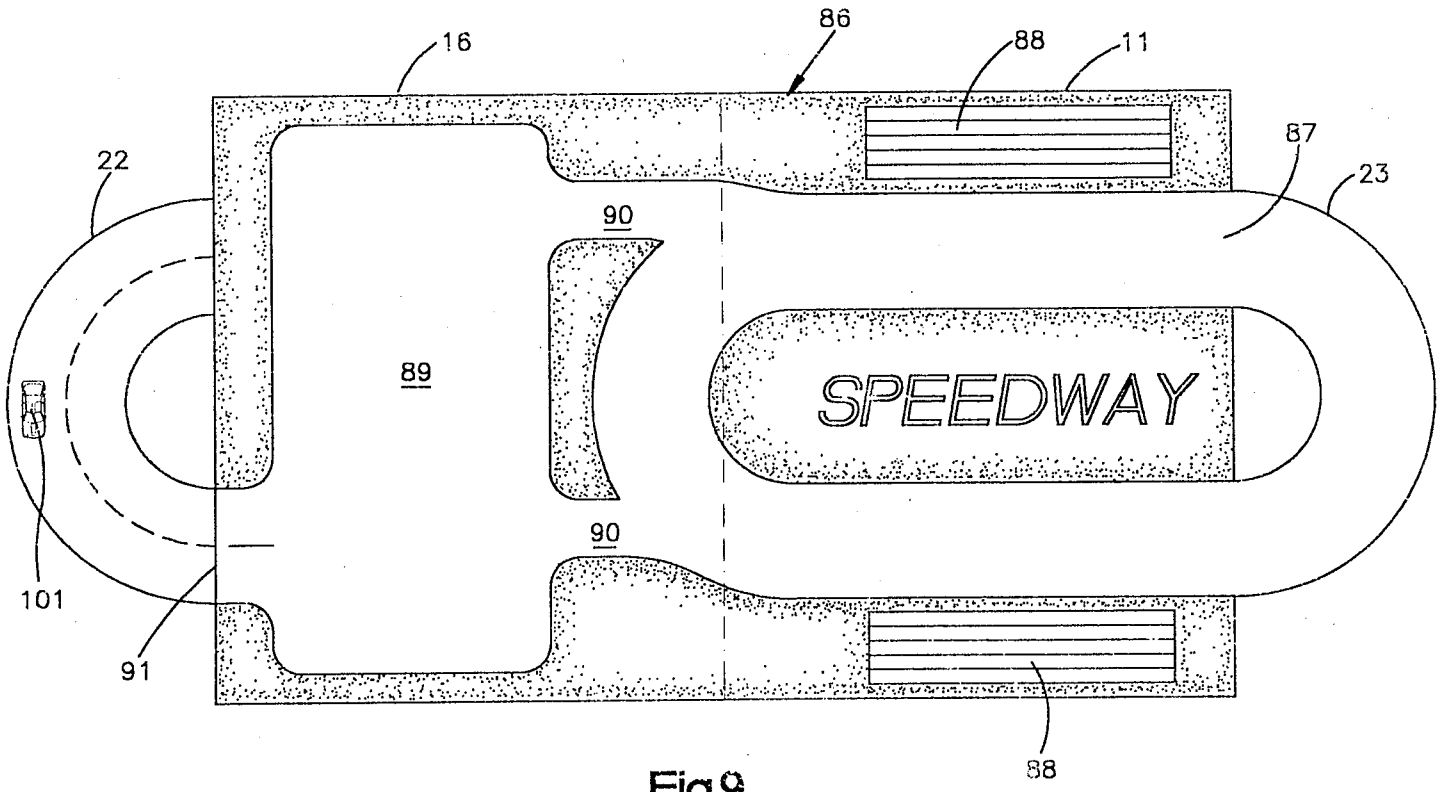
FIG. 9 is a landscape illustrating a speedway.

When the last page 16 is turned, the last landscape 86 illustrated in FIG. 9 is provided. In this instance, half of the landscape is printed on the inside of the back cover 11 of the book and, in conjunction with the last page 16, illustrates a speedway landscape. The speedway landscape has a racing oval 87, including as part of the oval the roadway section 23. Along the sides of the speedway are bleachers 88. A parking lot 89 joins with the speedway 87 through drives 90. Also, the parking lot connects through a roadway end 91 with the roadway section 22.

It should be understood that the illustrated landscapes are only representative of a variety of landscape types which may be incorporated into a single book. Additional landscapes can be incorporated into a book by adding additional pages. It is desirable, however, to provide landscapes of many different types so that a child will be exposed to as much variety as possible.

further, it is contemplated that advertising can be sold to provide income to the publisher of the book. For example a shopping center landscape 52 illustrates six different stores 54. Each of these stores can provide advertising for a given store or chain of stores by printing the name of a particular store on the roof of the respective stores 54. Similarly, the fast-food restaurant 77 can be provided with the name of one of the fast-food franchise systems, providing a very effective advertisement, since children often urge their parents to take them to a particular fast-food outlet. The filling station 78 also can advertise one of the oil companies. Even the speedway can contain advertising subject matter of one of the nation's speedways or performance products.

The manner in which the book is used by a child is as follows. A miniature vehicle is placed on the roadway section 22 of the landscape 26 (illustrated in FIG. 3) when the book is first opened. The child then moves the vehicle from the position 92 along the roadway 21, as indicated by arrows. The child may drive the vehicle in along the drive 32 to the loading dock 28 or along the driveway 34 to the post office. Ultimately, the vehicle is driven to the roadway section 23, as illustrated at 94. When the vehicle is on either of the roadway sections 22 or 23, the pages are clear and can be turned to select a new landscape.

After turning the page, the child moves the vehicle along the roadway 21 of the landscape 36 (illustrated in FIG. 4) from the location 94, as indicated by the arrows. If desired, toy farm vehicles can be used with the landscape.

When the vehicle reaches the roadway section 22 and is positioned, for example, at the location 96, the pages are again turned to expose the landscape 46, illustrated in FIG. 5. The vehicle is then be driven from the location 96 along the roadway 21 of the landscape 46 to any one of the residential driveways. After completing the play by driving along the landscape 46, the vehicle is driven to the roadway section 23 at a position, such as the position 97, so that the pages can be again turned. The adjacent landscape roadways 21 connect with opposite ends of the roadway sections 22 and 23 so that the vehicle can be driven onto and off the roadway segments without U-turns.

The child then drives the vehicle from the position 97 along the landscape 52 to visit each of the stores 54. Thereafter, the vehicle is driven to the roadway section 22 and positioned at 98, again permitting the pages to be turned to the landscape 61, illustrated in FIG. 7.

From the position 98, the vehicle is driven along the roadways and driveways of the landscape 61, and then driven to the roadway section 23 to the position 99.

It should be understood that, if desired, the child can use more than one vehicle, and that the description of the use of this book with only one vehicle is merely representative of the manner in which the child can play with the book.

After the pages are turned to the landscape 76 (illustrated in FIG. 8), the vehicle is driven from the location 99 on the roadway section 23 to the fast-food restaurant 77 and the filling station 78. Further, if a similar book is positioned so that one of its roadways aligns with the roadway ends 83 and 84, the vehicle can be driven to the adjacent book, where play can be continued. When only one book is used, the vehicle is driven to the roadway section where the vehicle is positioned at the location 101 to allow turning of the last page to disclose the speedway landscape 86 of FIG. 9. The vehicle is then driven onto the landscape and around the speedway as many times as the child wishes. Further, if the child wishes to return to earlier landscapes, it is merely necessary to position the vehicle on one of the roadway extensions 22 or 23 and to appropriately turn the pages to the desired landscape.

With this simple and very compact book, a large number of roadway landscapes are provided so that a child can have a variety of roadway experiences. Further, by placing appropriate signs, such as the stop sign 100, and names along the roadways, the child's reading skills can be developed. Since the hinge connection for the pages and covers is such that the book lies open and flat, the vehicle can be moved along the roadway easily from one side of the landscape to the other. Further, the covers are preferably relatively stiff so that the book can be used even when resting on the child's lap.

Although the preferred embodiment of this invention has been shown and described, it should be understood that various modifications and rearrangements of the parts may be resorted to without departing from the scope of the invention as disclosed and claimed herein.

What is claimed is:

1. A book comprising front and back covers, a plurality of pages between said covers, hinge means connecting said covers and pages along one edge so that said covers can be opened and said pages can be turned, said covers providing extensions projecting beyond adjacent edges of said pages, indicia on said pages depicting a plurality of roadway landscapes, turning of said pages exposing selected roadway landscapes, indicia on said extension depicting roadway sections on which toy vehicles can rest while said pages are turned.

2. A book as set forth in claim 1, wherein said roadway landscapes provide landscape roadways matching said roadway sections on said extensions permitting movement of said toy vehicles along said landscape roadways to and from said roadway sections.

3. A book as set forth in claim 2, wherein said extensions are along the edges of said covers remote from said hinge means.

4. A book as set forth in claim 3, wherein said extensions provide finger-receiving openings permitting said extensions to be used as handles.

5. A book as set forth in claim 2, wherein said landscapes represent a plurality of different environments.

6. A book as set forth in claim 3, wherein at least one of said landscapes represents a shopping center.

7. A book as set forth in claim 3, wherein one of said landscapes represents a residential neighborhood.

8. A book as set forth in claim 3, wherein one of said landscapes represents a rural area.

9. A book as set forth in claim 3, wherein one of said landscapes includes a representation of a police department and a hospital.

10. A children's roadway toy comprising a plurality of pages connected along one edge with hinge means permitting said pages to be turned to expose facing sides of said pages, indicia on said pages depicting a plurality of roadway landscapes selectively exposed when said pages are turned, said roadway landscapes providing landscape roadways, said toy providing projections extending beyond adjacent edges of said pages, indicia on said projections depicting roadway segments permitting a toy vehicle to be moved along said landscape roadways on said roadway landscapes on said pages onto said roadway segments on said projections when said pages are turned to expose a new roadway landscape.

11. A toy as set forth in claim 10, wherein said roadway segment has two ends, and one landscape roadway joins with one of said ends and landscape roadways on adjacent pages join with the other of said two ends.

12. A book as set forth in claim 1, wherein at least one of said landscapes provides a roadway landscape extending to the edge of an associated page adapted to be positioned in alignment with a corresponding roadway landscape of another book to allow toy vehicles to be driven from one book to said another book.

13. A children's roadway toy as set forth in claim 10, in which at least one of said landscape roadways extends to an edge of the associated pages spaced from said roadway segments permitting said toy to be positioned adjacent to another roadway toy so that a toy vehicle can be driven from one toy to said another roadway toy.

* * * * *